US008272210B2

(12) United States Patent
Keller

(10) Patent No.: US 8,272,210 B2
(45) Date of Patent: Sep. 25, 2012

(54) TAIL PIPE EXHAUST COOLING DEVICE

(75) Inventor: Martin Keller, Toledo, OH (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 303 days.

(21) Appl. No.: 12/386,449

(22) Filed: Apr. 17, 2009

(65) Prior Publication Data

US 2009/0282818 A1 Nov. 19, 2009

Related U.S. Application Data

(60) Provisional application No. 61/124,696, filed on Apr. 18, 2008.

(51) Int. Cl.
*F01N 3/05* (2006.01)

(52) U.S. Cl. ..... 60/317; 60/320

(58) Field of Classification Search ..... 60/317, 60/319, 289, 293, 304, 307, 320
See application file for complete search history.

(56) References Cited

U.S. PATENT DOCUMENTS

| | | | | |
|---|---|---|---|---|
| 1,813,189 | A | 7/1931 | Moore | |
| 2,586,788 | A | 2/1952 | Cushman | |
| 4,227,651 | A | 10/1980 | Abe | |
| 4,876,851 | A * | 10/1989 | Mueller | 60/264 |
| 5,606,854 | A * | 3/1997 | Hoffmann | 60/274 |
| 2006/0277901 | A1 | 12/2006 | Allegre et al. | |

FOREIGN PATENT DOCUMENTS

JP 57018417 A * 1/1982

* cited by examiner

*Primary Examiner* — Thomas Denion
*Assistant Examiner* — Jonathan Matthias
(74) *Attorney, Agent, or Firm* — Wood, Phillips, Katz, Clark & Mortimer

(57) ABSTRACT

An exhaust cooling device (10) is provided for an exhaust pipe (12) of a combustion process. The cooling device (10) includes a tubular housing (20) having an upstream portion (16) and a downstream portion (18), with the upstream portion (16) having a necked-down section (24) tapered in an upstream direction, and a plurality of openings (30) formed in the necked-down section (24) to allow an ambient air flow from an exterior of the tubular housing (20) to an interior of the tubular housing (20). The cooling device (10) further includes a nozzle element (22) fixed in the necked-down section (24) to direct an exhaust gas flow into the tubular housing (20).

18 Claims, 2 Drawing Sheets

TAIL PIPE EXHAUST COOLING DEVICE

CROSS-REFERENCE TO RELATED APPLICATIONS

This application claims the benefit of the filing date of U.S. Provisional Application No. 61/124,696, filed Apr. 18, 2008, which is hereby incorporated by reference.

FEDERALLY SPONSORED RESEARCH OR DEVELOPMENT

Not Applicable.

MICROFICHE/COPYRIGHT REFERENCE

Not Applicable.

FIELD OF THE INVENTION

The disclosure relates generally to exhaust treatment devices and more specifically to a vehicle exhaust pipe component or attachment for reducing exhaust temperature and/or eliminating hot spots in the exhaust flow exiting a vehicle.

BACKGROUND OF THE INVENTION

The statements in this section merely provide background information related to the present disclosure and may not constitute prior art.

Conventional tail pipe exhaust temperatures, especially for diesel particulate filter applications, show peaks as high as 650° C. Such exhaust gas temperatures can potentially ignite flammable materials, such as dry grass along a roadside. Hence, there is seen to be a need in the art for a component device for an exhaust system, such as a vehicle exhaust system including a tail pipe, for lowering the exhaust temperatures of the exhaust flow emanating from the vehicle.

SUMMARY OF THE INVENTION

In accordance with one feature of the invention, a exhaust cooling device is provided for an exhaust pipe of a combustion process. The cooling device includes a tubular housing having an upstream portion and a downstream portion, with the upstream portion having a necked-down section tapered in an upstream direction, and a plurality of openings formed in the necked down section to allow an ambient air flow from an exterior of the tubular housing to an interior of the tubular housing. The cooling device further includes a nozzle element fixed in the necked down section to direct an exhaust gas flow into the tubular housing.

As one feature of the invention, the necked-down section has a frusto-conical shape that tapers from a cylindrical shaped section of the upstream portion.

According to one feature, the nozzle element has a frusto-conical shape that tapers from in a downstream direction from an annular flange to a nozzle exit, with the annular flange of the nozzle fixed to a closely conforming annular flange of the necked-down section of the tubular housing.

In one feature, the nozzle element is formed on a terminal end of an exhaust pipe.

As one feature, the openings are circumferentially spaced around the necked-down section. In a further feature, each opening is elongate in the circumferential direction with a periphery defined by a circumferentially extending upstream edge, a circumferentially extending downstream edge, and two circumferentially spaced side edges extending connecting the upstream and downstream edges. In yet a further feature, at least the downstream edge is defined by an inwardly directed flange. As an additional feature, all of the edges are defined by an inwardly directed flange.

According to one feature, each of the openings has a periphery defined at least in part by an inwardly directed flange. As an additional feature, the inwardly directed flange is limited to a downstream portion of the periphery for each of the openings. In an alternate feature, the inwardly directed flange extends along the entire periphery for each of the openings.

In one feature, the cooling device further includes a debris shield spaced outwardly from the tubular housing and extending axially to over at least the necked down section of the tubular housing to restrict entry of debris through the openings.

In accordance with one feature of the invention, an exhaust cooling device is provided for an exhaust pipe of a combustion process. The cooling device includes a tubular housing having an upstream portion and a downstream portion connected by a cylindrical section of the housing, with the upstream portion having a frusto-conical shaped section tapered in an upstream direction, and a plurality of circumferentially spaced openings formed in the frusto-conical shaped section to allow an ambient air flow from an exterior of the tubular housing to an interior of the tubular housing. The cooling device further includes a frusto-conical shaped nozzle element tapered in the downstream direction and fixed in the upstream portion to direct an exhaust gas flow into the tubular housing.

As one feature, the nozzle element has an annular flange fixed to a closely conforming annular flange of the upstream portion of the tubular housing.

In one feature, the nozzle element is formed on a terminal end of an exhaust pipe.

According to one feature, each opening is elongate in the circumferential direction with a periphery defined by a circumferentially extending upstream edge, a circumferentially extending downstream edge, and two circumferentially spaced side edges extending connecting the upstream and downstream edges. As a further feature, at least the downstream edge is defined by an inwardly directed flange.

In one feature, each of the openings has a periphery defined at least in part by an inwardly directed flange. As an additional feature, the inwardly directed flange is limited to a downstream portion of the periphery for each of the openings. In an alternate additional feature, the inwardly directed flange extends along the entire periphery for each of the openings.

Other objects, features, and advantages of the invention will become apparent from a review of the entire specification, including the appended claims and drawings.

DETAILED DESCRIPTION OF THE PREFERRED EMBODIMENT

Figures 1, 2, 3, 4, 5:
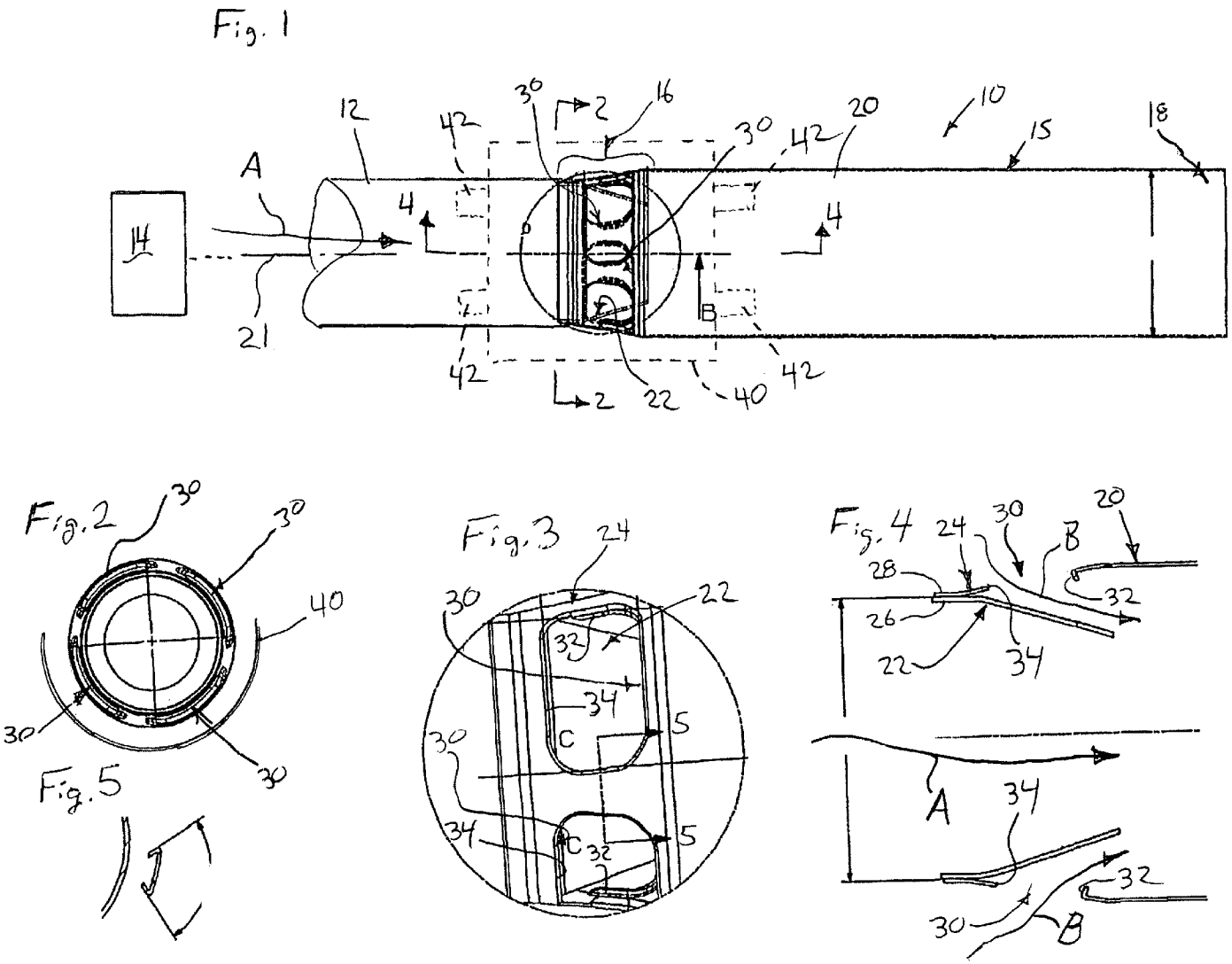
FIG. 1 is a side view of an exhaust cooling component arranged in accordance with the principles of the invention.
FIG. 2 is an end view taken from line 2-2 in FIG. 1.
FIG. 3 is an enlarged view of an upstream end portion of the component of FIG. 1.
FIG. 4 is an enlarged section view taken from line 4-4 in FIG. 1.
FIG. 5 is a section view taken from line 5-5 in FIG. 3.

With reference to FIG. 1, an exhaust cooling device 10 is intended preferably for coupling to a tail pipe 12 of a vehicular exhaust system, shown diagrammatically at 14, to cool an exhaust gas flow, shown by arrow A. The cooling device 10 includes an upstream end portion 16 and a downstream end portion 18 with a cylindrical housing or pipe 20 extending between the upstream and downstream portions 16 and 18, with the portion 18 preferably being an open end of the cylindrical housing/pipe 20.

Figure 6:
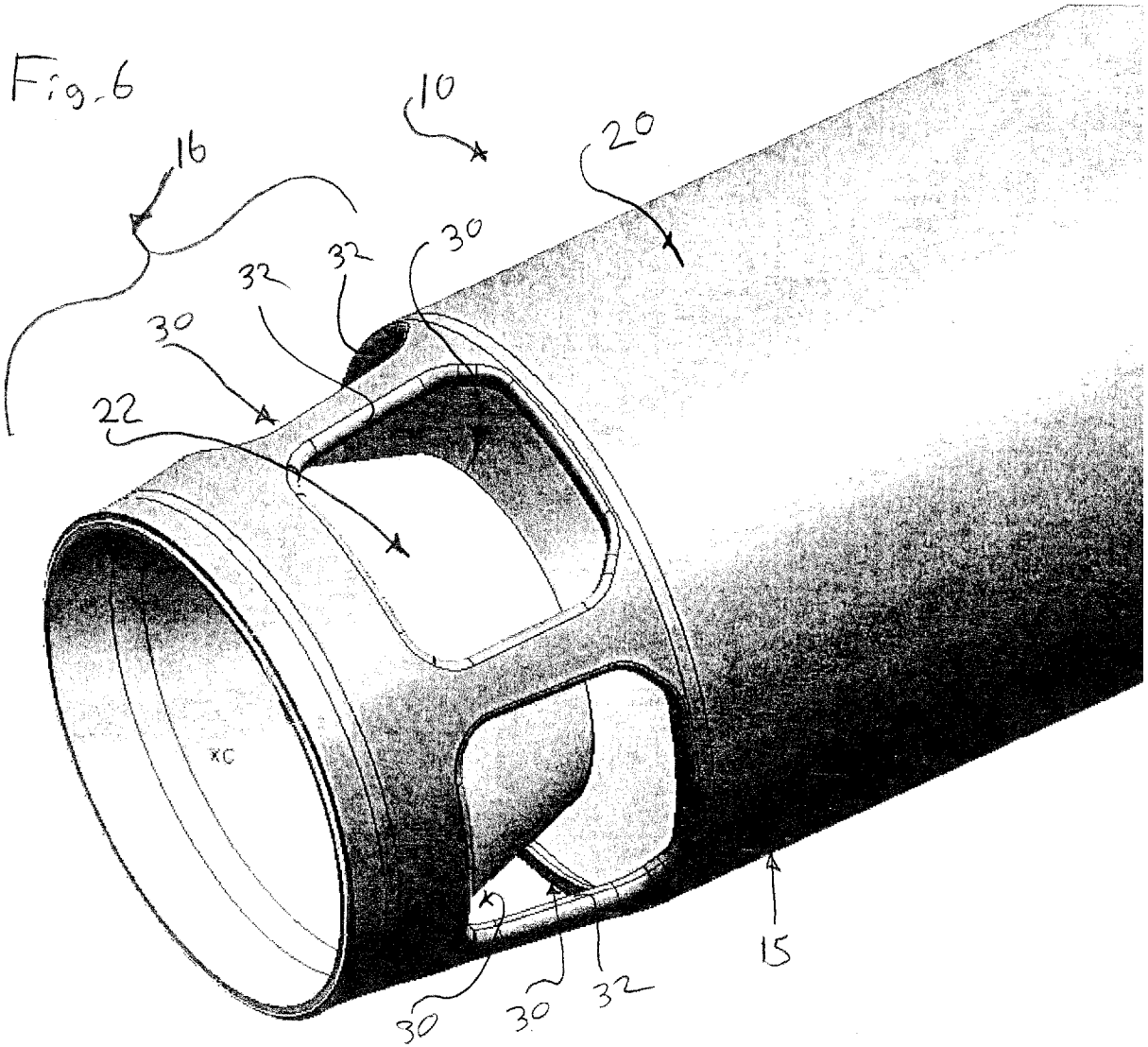
FIG. 6 is an enlarged, partial perspective view of the component of FIG. 1.

With reference to FIGS. 1-6, the upstream portion 16 includes a venturi forming element or nozzle 22 that is received in a necked-down section 24 of the housing/pipe 20. The venturi/nozzle element 22 preferably has a frusto conical shape that is tapered in a downstream direction from an annular portion or flange 26 that is bonded, such as by welding or brazing, to a closely conforming annular flange 28 on the section 24. Similarly, the annular flange 28 can be received in the downstream end of the tail pipe 12 that closely conforms to the flange 28 and is bonded thereto, again such as by welding or brazing. Alternatively, while the venturi/nozzle element 22 is shown as a separate piece part of the device 10, it can optionally be provided in the form of a necked-down end portion of the tail pipe 12 that is shaped to the desired geometry for the nozzle/element 22 and received in the necked-down section 24 of the housing/pipe 20. The section 24 includes a plurality (4 in the illustrated embodiment) of circumferentially spaced openings or windows 30 that allow a cooling air flow, shown by arrows B in FIG. 4, from the surrounding ambient environment to enter the device 10 for cooling of the exhaust flow A. In this regard, the frusto conical shape of the venturi/nozzle element 22 creates a higher exhaust flow velocity for the exhaust flow A as it exits the venturi/nozzle element 22, resulting in a suction effect, which in turn draws the colder environmental ambient air B into the housing/pipe 20 for mixing and cooling the exhaust flow A. Each of the windows 30 preferably has an inwardly directed flange 32 that extends either over the entirety of the periphery of the window 30, as shown in FIG. 6, or over at least part of the downstream periphery of the window 30, as shown in FIGS. 3 and 4. In this regard, as seen in the embodiment of FIGS. 3 and 4, the flange 32 is not located over the leading edge 34 of each window 30.

Optionally, but preferably, a mud/debris shield 40 can be provided to extend axially over at least the end portion 16 and completely or at least partially circumferentially over the end portion 16 (as shown in FIG. 2) to limit or restrict mud and/or other debris from entering the device 10 via the windows 30. The shield 40 can either be connected to the exhaust pipe 12, to the housing/pipe 20, or to another component or structure of the vehicle using any suitable connector, such as by bonding with braze or welding, or by use of a hose clamp or other suitable mechanical fastener. In this regard, suitable struts or legs, such as shown for example at 42 in FIG. 1 can extend from the shield 40 to the housing/pipe 20 and/or the tail pipe 12 for mounting of the shield 40.

It is preferred that the housing/pipe 20 have a sufficient length so that the end portion 16 is not generally visible to observer's in other vehicles or pedestrians passing the vehicle. In this regard, it will be appreciated that by providing the end portion 16 on the upstream end of the device 10, the cooling device 10 can provide the vehicle with a standard looking exhaust pipe while also provide the desired cooling of the exhaust flow.

It should be appreciated that the geometrical specifics of the venturi/nozzle 22 and the windows 30 will be highly dependent upon the particular application, including, for example, the geometry of the mating parts (tail pipe 12) of the exhaust system 14, the temperature of the exhaust flow before it enters the device 10, the desired outlet temperature of the exhaust flow, the volume of the exhaust flow during various operating conditions, the anticipated temperature range of the environmental ambient air that will be drawn into the device 10 for cooling, and the acceptable back pressure from the device 10. Accordingly, other suitable shapes may be used for the venturi/nozzle 22 and/or windows 30.

The invention claimed is:

1. An exhaust cooling device for an exhaust pipe of a combustion process, the cooling device comprising:

a tubular housing having an upstream portion and a downstream portion, the upstream portion having a necked-down section tapered in an upstream direction, a plurality of openings formed in the necked-down section to allow an ambient air flow from an exterior of the tubular housing to an interior of the tubular housing; and a nozzle element fixed in the necked-down section to direct an exhaust gas flow into the tubular housing wherein the nozzle element has a frusto-conical shape that tapers radially inwardly in a downstream direction from an annular flange to a nozzle exit, the annular flange of the nozzle fixed directly to a surface of the necked-down section defining the interior of the tubular housing.

2. The cooling device of claim 1 wherein the necked-down section has a frusto-conical shape that tapers from a cylindrical shaped section of the upstream portion.

3. The cooling device of claim 1 wherein the nozzle element is formed on a terminal end of an exhaust pipe.

4. The cooling device of claim 1 wherein the openings are circumferentially spaced around the necked-down section.

5. The cooling device of claim 4 wherein each opening is elongate in the circumferential direction with a periphery defined by a circumferentially extending upstream edge, a circumferentially extending downstream edge, and two circumferentially spaced side edges connecting the upstream and downstream edges.

6. The cooling device of claim 5 wherein at least the downstream edge is defined by an inwardly directed flange.

7. The cooling device of claim 6 wherein all of the edges are defined by an inwardly directed flange.

8. The cooling device of claim 1 wherein each of the openings has a periphery defined at least in part by an inwardly directed flange.

9. The cooling device of claim 8 wherein the inwardly directed flange is limited to a downstream portion of the periphery for each of the openings.

10. The cooling device of claim 8 wherein the inwardly directed flange extends along the entire periphery for each of the openings.

11. The cooling device of claim 1 further comprising a debris shield spaced outwardly from the tubular housing and extending axially to over at least the necked down section of the tubular housing to restrict entry of debris through the openings.

12. An exhaust cooling device for an exhaust pipe of a combustion process, the cooling device comprising:

a tubular housing having an upstream portion and a downstream portion connected by a cylindrical section of the housing, the upstream portion having a frusto-conical shaped section tapered in an upstream direction, a plurality of circumferentially spaced openings formed in the frusto-conical shaped section to allow an ambient air flow from an exterior of the tubular housing to an interior of the tubular housing; and a nozzle element fixed in the upstream portion to direct an exhaust gas flow into the tubular housing wherein the nozzle element has a frusto-conical shape that tapers radially inwardly in a downstream direction from an annular flange to a nozzle exit, the annular flange of the nozzle fixed to a surface of the necked-down section defining the interior of the tubular housing.

13. The cooling device of claim 12 wherein the nozzle element is formed on a terminal end of an exhaust pipe.

14. The cooling device of claim 12 wherein each opening is elongate in the circumferential direction with a periphery defined by a circumferentially extending upstream edge, a circumferentially extending downstream edge, and two circumferentially spaced side edges connecting the upstream and downstream edges.

15. The cooling device of claim 14 wherein at least the downstream edge is defined by an inwardly directed flange.

16. The cooling device of claim 12 wherein each of the openings has a periphery defined at least in part by an inwardly directed flange.

17. The cooling device of claim 16 wherein the inwardly directed flange is limited to a downstream portion of the periphery for each of the openings.

18. The cooling device of claim 16 wherein the inwardly directed flange extends along the entire periphery for each of the openings.

* * * * *